US009986839B2

(12) United States Patent
Pectol

(10) Patent No.: US 9,986,839 B2
(45) Date of Patent: Jun. 5, 2018

(54) BANQUET CHAIR WITH OUTER SPRING

(71) Applicant: Mity-Lite, Inc., Orem, UT (US)

(72) Inventor: Matthew Pectol, Fruit Heights, UT (US)

(73) Assignee: Mity-Lite, Inc., Orem, UT (US)

( * ) Notice: Subject to any disclaimer, the term of this patent is extended or adjusted under 35 U.S.C. 154(b) by 114 days.

(21) Appl. No.: 15/134,699

(22) Filed: Apr. 21, 2016

(65) Prior Publication Data

US 2016/0316916 A1 Nov. 3, 2016

Related U.S. Application Data

(60) Provisional application No. 62/155,287, filed on Apr. 30, 2015.

(51) Int. Cl.
*A47C 7/44* (2006.01)

(52) U.S. Cl.
CPC ..... *A47C 7/445* (2013.01)

(58) Field of Classification Search
CPC ..... A47C 1/03261; A47C 7/44; A47C 3/023; B60N 2/028
USPC ..... 297/285, 452.1–452.65, 239
See application file for complete search history.

(56) References Cited

U.S. PATENT DOCUMENTS 3,512,831 A * 5/1970 Flint ..... A47C 7/14 297/285
4,557,521 A * 12/1985 Lange ..... A47C 3/12 297/285
4,744,603 A * 5/1988 Knoblock ..... A47C 1/03255 297/285
5,100,201 A * 3/1992 Becker, III ..... A47C 7/14 297/296
5,123,702 A * 6/1992 Caruso ..... A47C 3/04 297/239
5,551,758 A * 9/1996 Leib ..... A47C 3/021 297/285
5,599,064 A * 2/1997 Vanderminden, Sr. ..... A47C 3/0252 297/258.1
5,997,094 A * 12/1999 Cvek ..... A47C 3/04 297/239
6,722,735 B2 * 4/2004 Lucci ..... A47C 3/04 297/300.1
6,761,406 B2 * 7/2004 Kinoshita ..... A47C 3/12 297/296
6,779,846 B2 8/2004 Spendlove et al.
6,896,328 B2 * 5/2005 Goodworth ..... A47C 3/026 297/297
7,073,864 B2 * 7/2006 Olsen ..... A47C 3/023 297/18
7,862,120 B2 * 1/2011 Ueda ..... A47C 1/03255 297/285

(Continued)

*Primary Examiner* — Jose V Chen
(74) *Attorney, Agent, or Firm* — Thorpe, North & Western, LLP

(57) ABSTRACT

A banquet chair comprises a seat and a backrest carried by a plurality of legs. A pair of arcuate leaf springs flexibly couples the backrest to the plurality of legs. The pair of arcuate leaf springs is spaced-apart, and each is located closer to a different outside edge of the seat and the backrest than to each other or a middle of the seat and the backrest. Each of the pair of arcuate leaf springs has an outermost edge exposed through a lateral perimeter of the backrest.

20 Claims, 10 Drawing Sheets

(56) References Cited

U.S. PATENT DOCUMENTS

| | | | | |
|---|---|---|---|---|
| 7,896,439 | B2 * | 3/2011 | Kan | A47C 3/021 297/285 |
| 8,567,864 | B2 * | 10/2013 | Deisig | A47C 3/045 297/285 |
| 8,616,640 | B2 * | 12/2013 | van Hekken | A47C 3/04 297/299 |
| 8,820,835 | B2 * | 9/2014 | Minino | A47C 7/44 297/285 |
| 2002/0000745 | A1 * | 1/2002 | Conte | A47C 3/025 297/302.3 |
| 2018/0042384 | A1 * | 2/2018 | Battey | A47C 7/54 |

* cited by examiner

BANQUET CHAIR WITH OUTER SPRING

PRIORITY CLAIM

Priority is claimed to U.S. Provisional Patent Application Ser. No. 62/155,287, filed Apr. 30, 2015, which is hereby incorporated herein by reference in its entirety.

BACKGROUND

Field of the Invention

The present invention relates generally to banquet chairs.

Related Art

Banquet chairs typically have fabric covered cushions, and are capable of stacking. Repeated or incorrect stacking of the chairs can damage the fabric cover. The development and improvement of chairs is an ongoing endeavor.

SUMMARY OF THE INVENTION

It has been recognized that it would be advantageous to develop a chair or banquet chair with improved stackability, and/or being capable of stacking while protecting a fabric surface.

The invention provides a banquet chair comprising a seat and a backrest carried by a plurality of legs. A pair of arcuate leaf springs flexibly couples the backrest to the plurality of legs. The pair of arcuate leaf springs is spaced-apart, and each is located closer to a different outside edge of the seat and the backrest than to each other or a middle of the seat and the backrest. Each of the pair of arcuate leaf springs has an outermost edge exposed through a lateral perimeter of the backrest.

In accordance with a more detailed aspect of the present invention, the lateral perimeter of the backrest can include a slimmer portion tapering inward from an intermediate portion to a bottom such that a width of the bottom of the backrest is less than a width of the intermediate portion of the backrest. The outermost edge of each of the pair of arcuate leaf springs can be exposed by the slimmer portion of the backrest. The outermost edge of each of the pair of arcuate leaf springs can have an associated bearing surface against which an interior surface of a rear leg of another chair stacked thereon can bear against when stacked thereon.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

The invention presents a banquet chair with a cushioned seat and/or a cushioned backrest. The banquet chair can be part of a seating system with a polarity of such chairs that are stackable together, one atop another. The backrest is pivotally or displaceably coupled to the seat so that the backrest can pivot rearwardly when a user leans back. The backrest is coupled to the seat by a pair of leaf springs that allow the backrest to pivot or displace, and that return the backrest to an upright position. In addition, the leaf springs provide resistance to pivoting or displacement of the backrest. The backrest and/or the seat can be shaped and sized, and the leaf springs can be located with respect to the backrest, so that an outermost edge of the leaf springs is exposed through the backrest, and between the seat and the backrest. The outermost exposed edge of the leaf springs, exposed by the lateral sides of the backrest and/or seat, provides a bearing surface. An interior surface of another chair, stacked thereof, can bear against the outermost exposed edge of the leaf spring, thus protecting the cushioned backrest and/or seat, and associated fabric of the cushion. Thus, when the similar or identical chairs are stacked together with one atop another and the lower chair nesting within the upper chair, the legs can hit and slide against the spring, rather than the upholstery, preserving the finish and appearance of the chairs.

Figure 1:
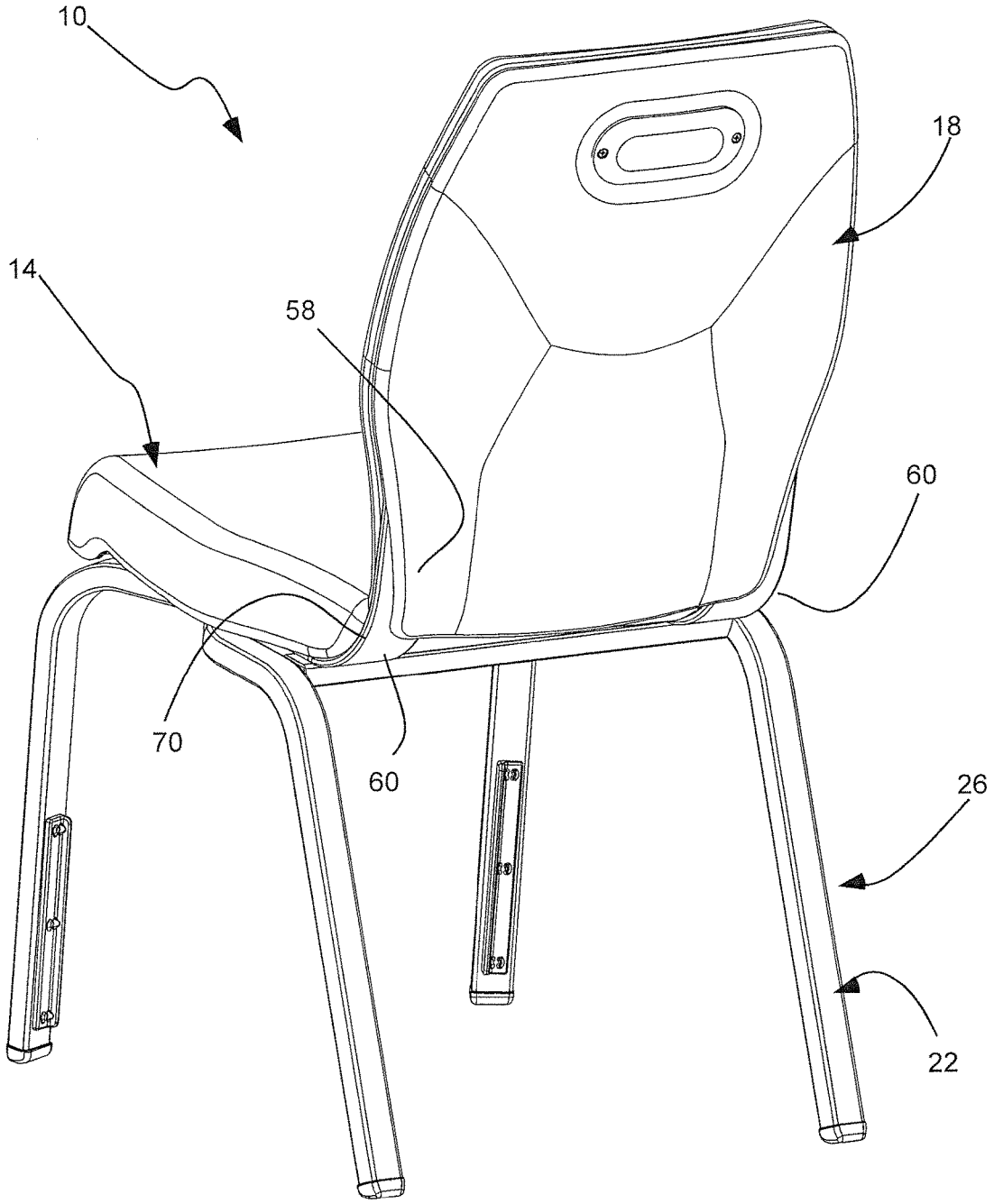
FIG. 1 is a rear perspective view of a banquet chair in accordance with an embodiment of the present invention.
Figure 2:
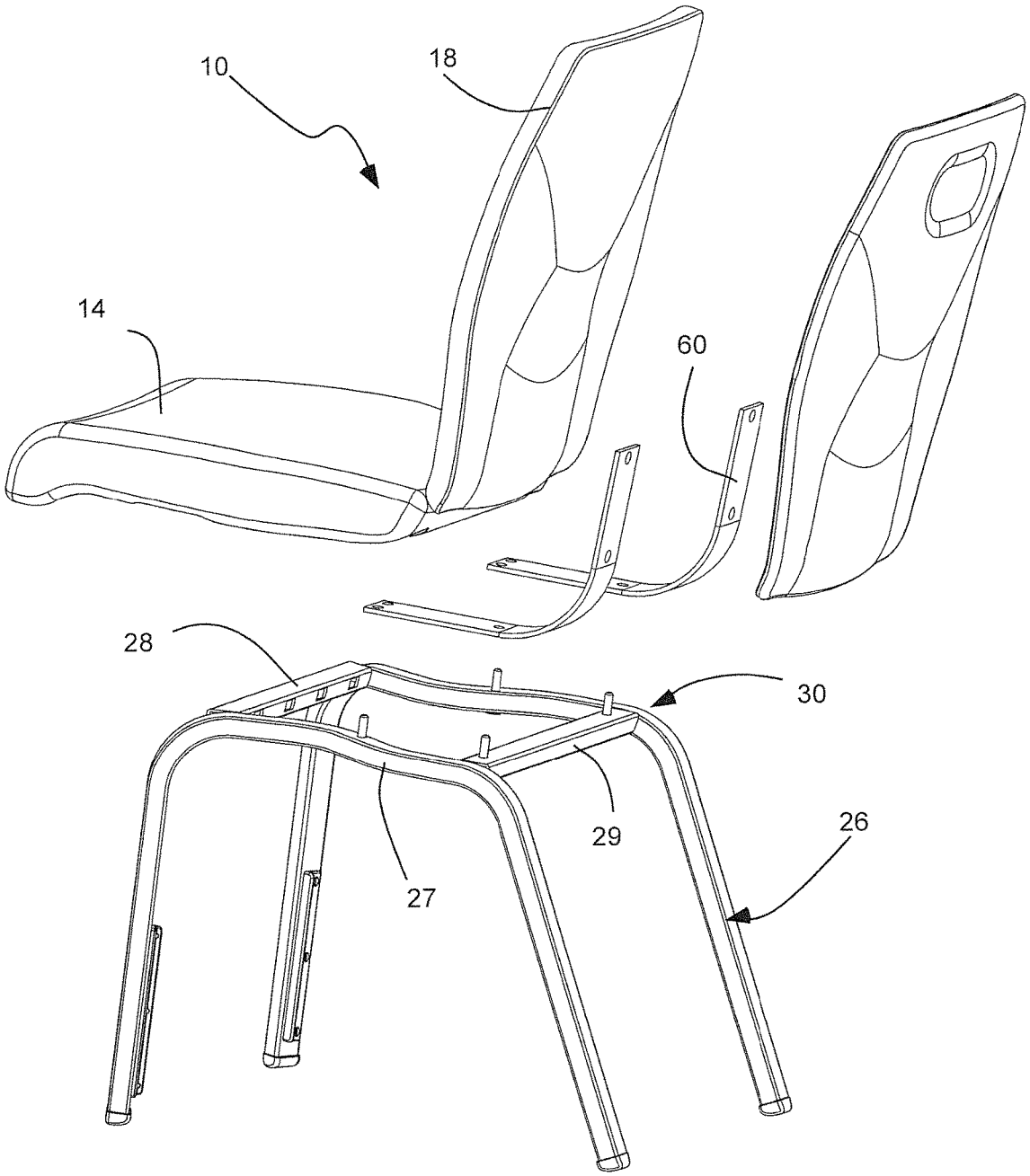
FIG. 2 is a rear perspective, partial exploded view of the chair of FIG. 1.
Figure 3:
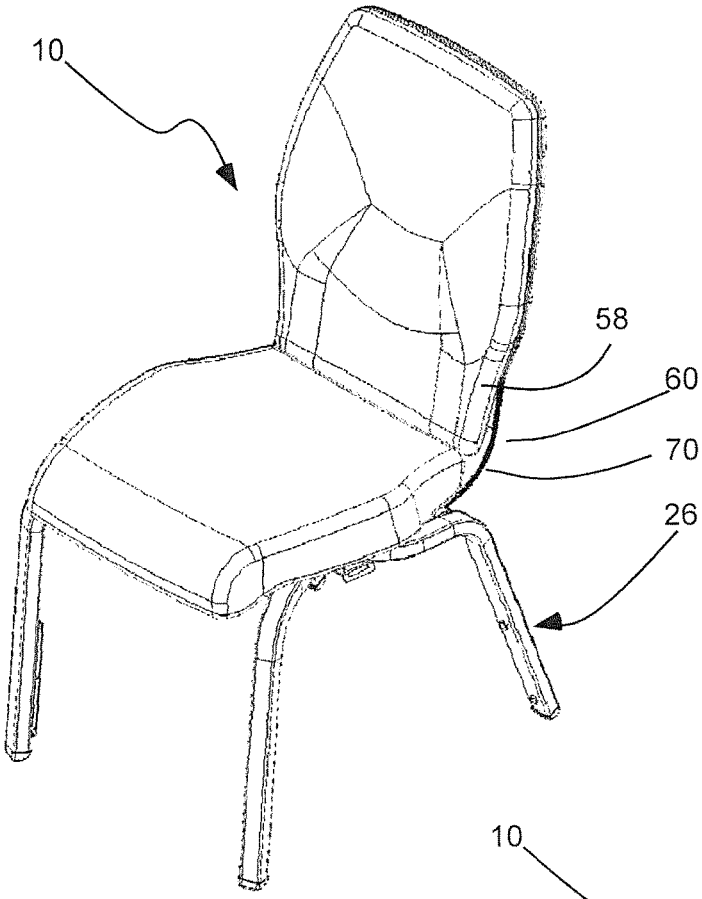
FIG. 3 is a front perspective view of the chair of FIG. 1.
Figure 4:
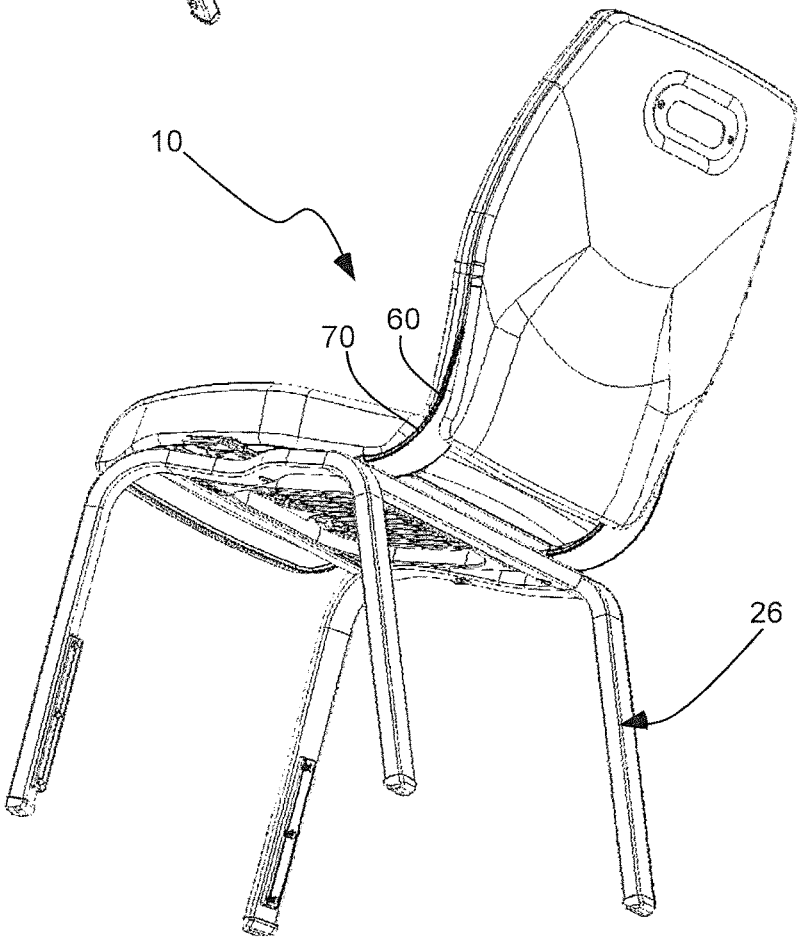
FIG. 4 is a rear bottom perspective view of the chair of FIG. 1.
Figure 5:
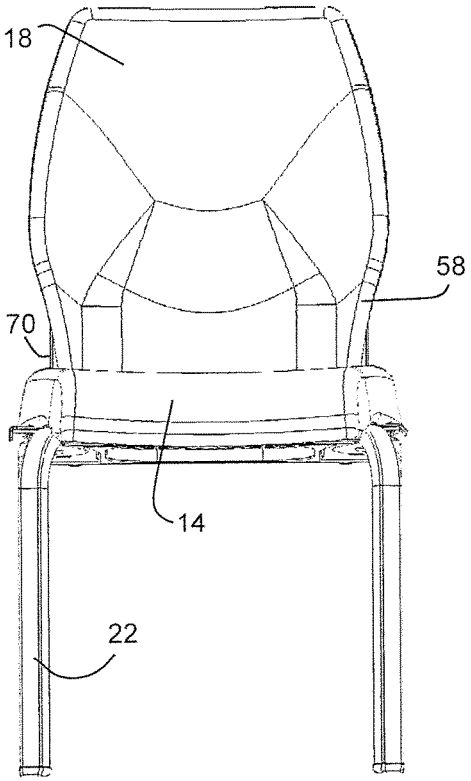
FIG. 5 is a front view of the chair of FIG. 1.
Figure 8:
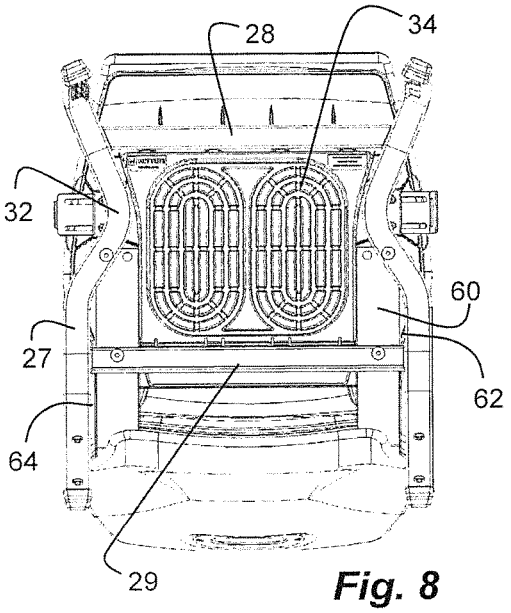
FIG. 8 is a bottom view of the chair of FIG. 1.
Figure 7:
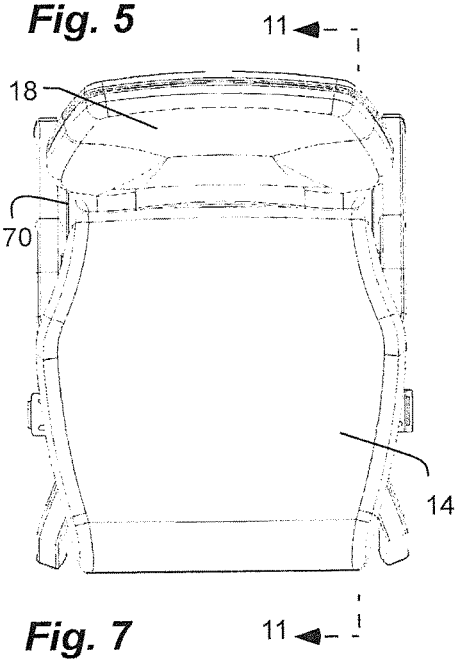
FIG. 7 is a top view of the chair of FIG. 1.
Figure 6:
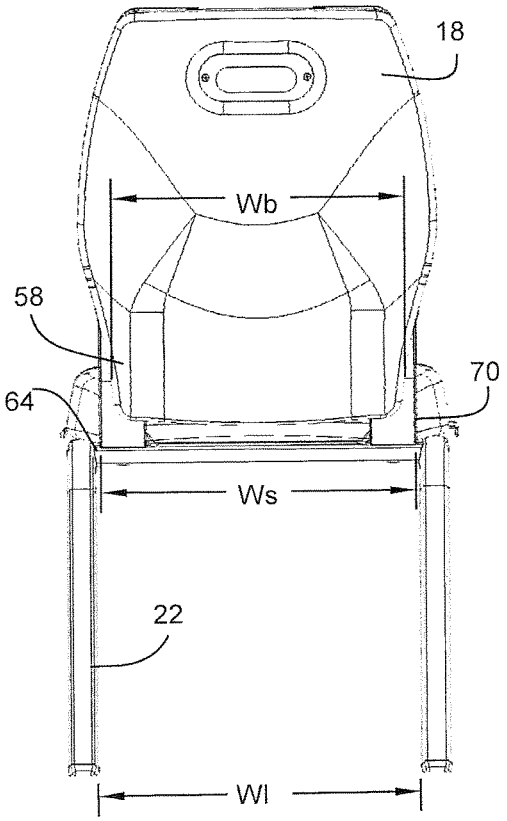
FIG. 6 is a rear view of the chair of FIG. 1.
Figure 9A:
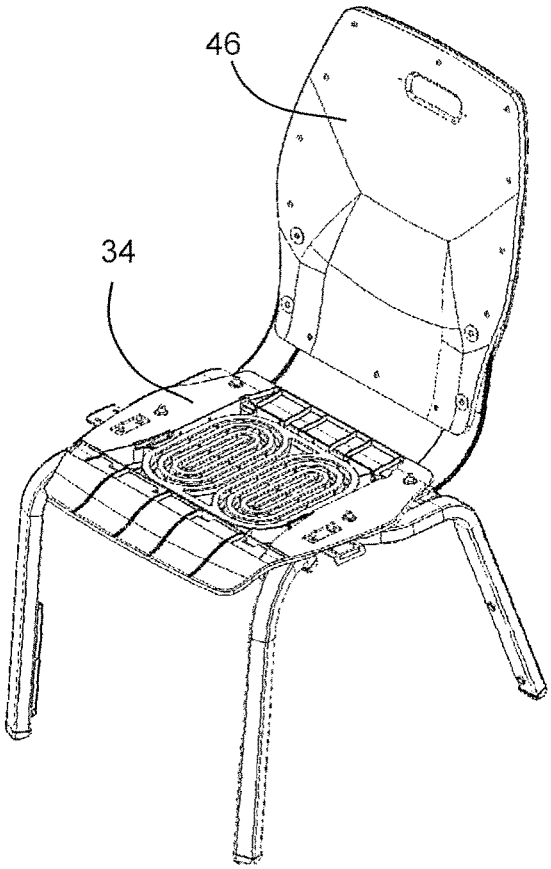
FIG. 9*a* is a front perspective view of a frame, a seat base and a backrest base of the chair of FIG. 1, shown with a seat cushion and a backrest cushion removed.
Figure 9B:
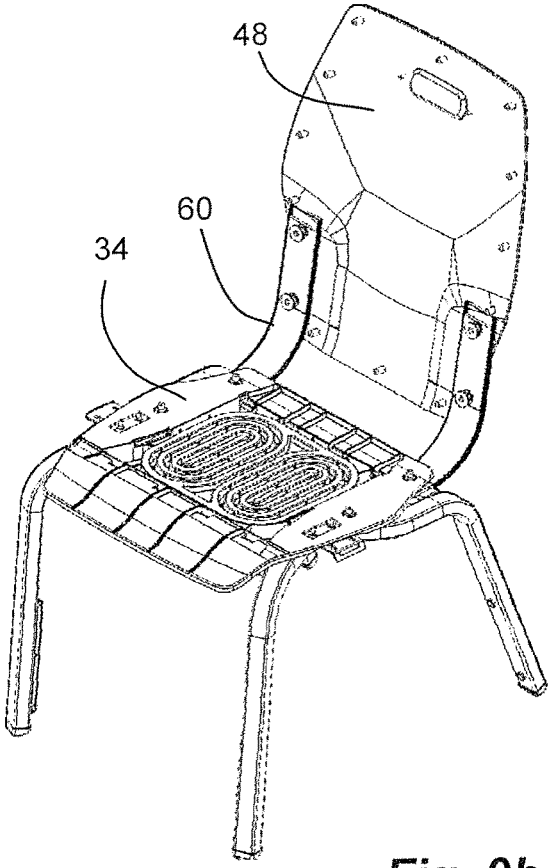
FIG. 9*b* is a front perspective view of the frame, the seat base and a rear panel of the backrest of the chair of FIG. 1, shown with the seat and backrest cushions removed, and with a front panel of the backrest removed.
Figure 9C:
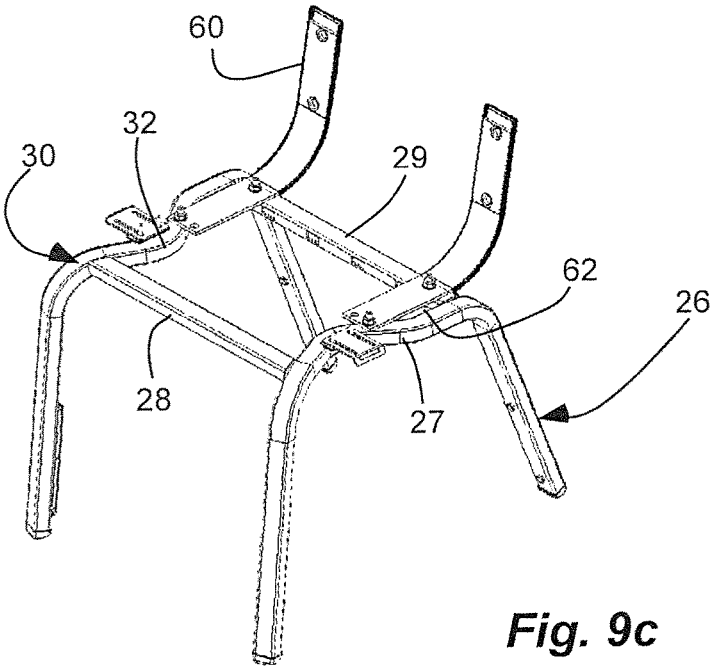
FIG. 9*c* is a front perspective view of the frame and arcuate leaf springs of the chair of FIG. 1, shown with a seat and a backrest removed.
Figure 10:
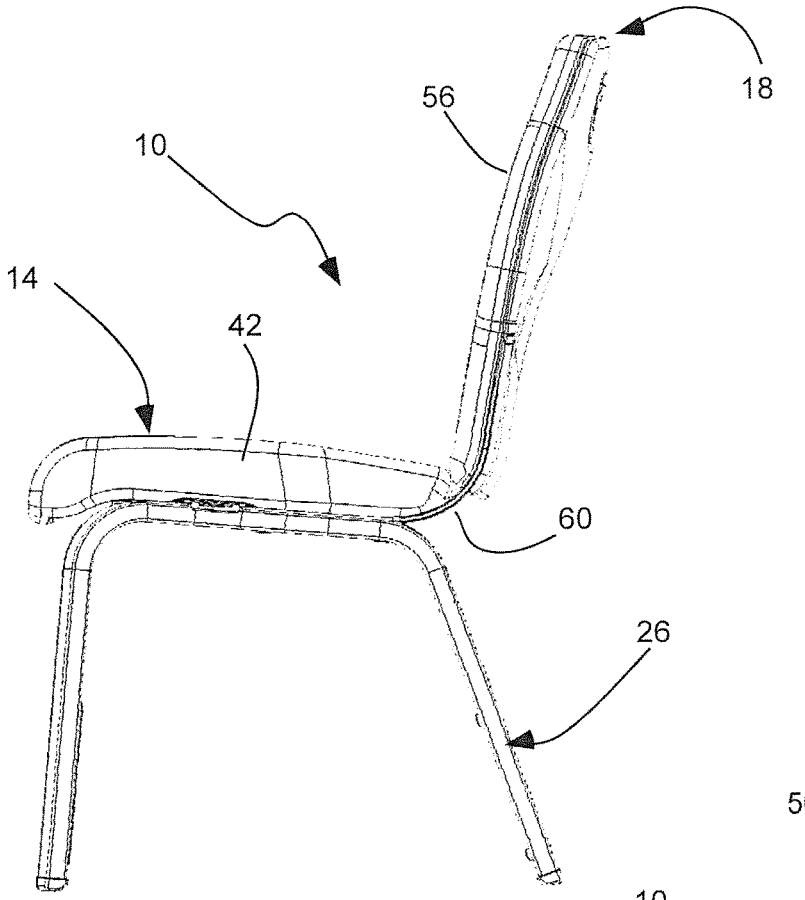
FIG. 10 is a side view of the chair of FIG. 1.
Figure 11:
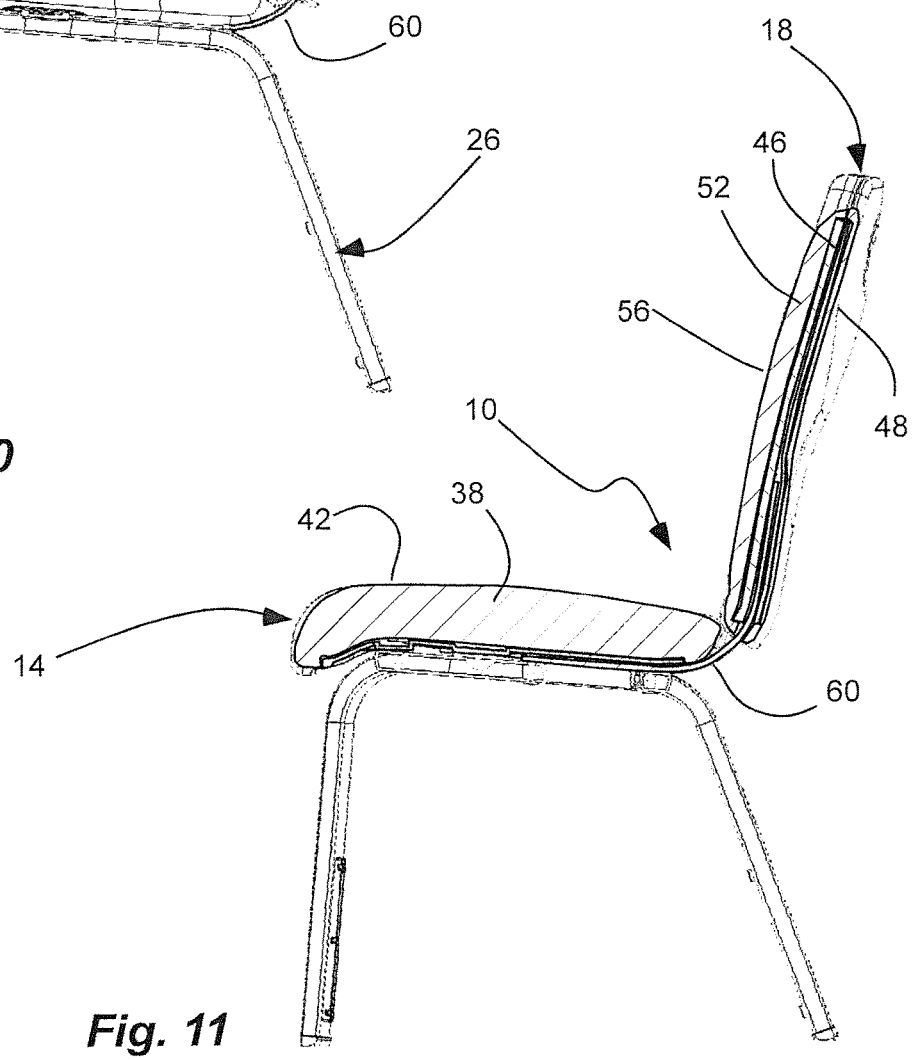
FIG. 11 is a cross-sectional side view of the chair of FIG. 1, taken along line 11 of FIG. 7.
Figure 12:
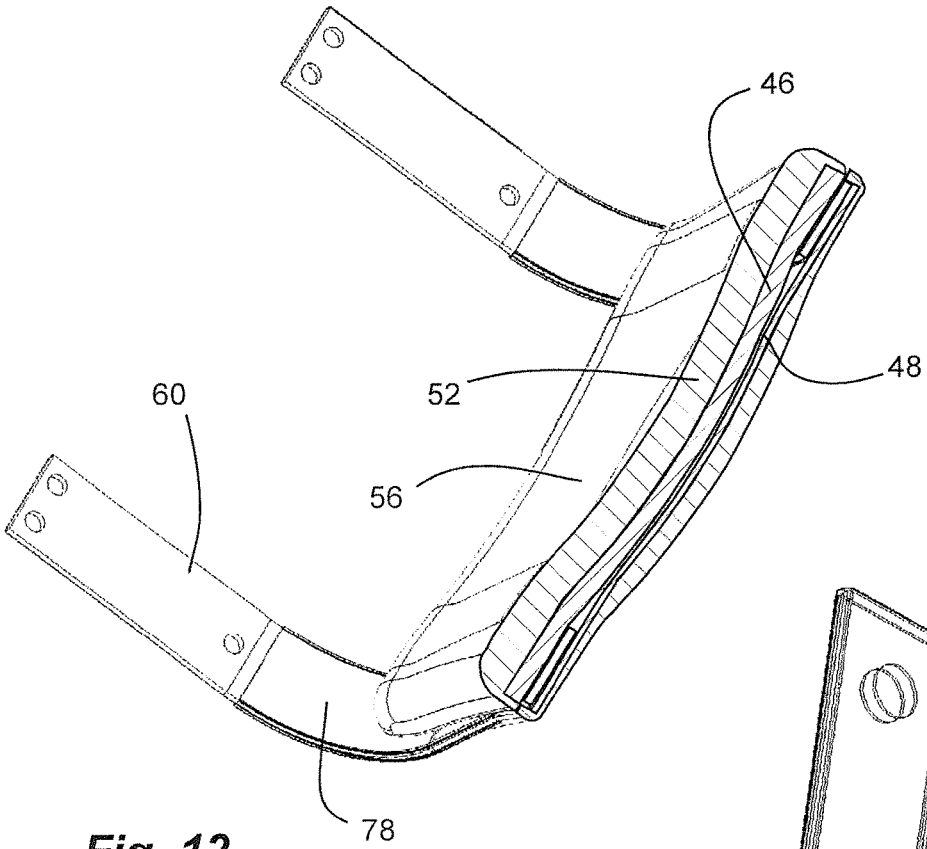
FIG. 12 is a cross-sectional top perspective view of the backrest of the chair of FIG. 1.
Figure 13:
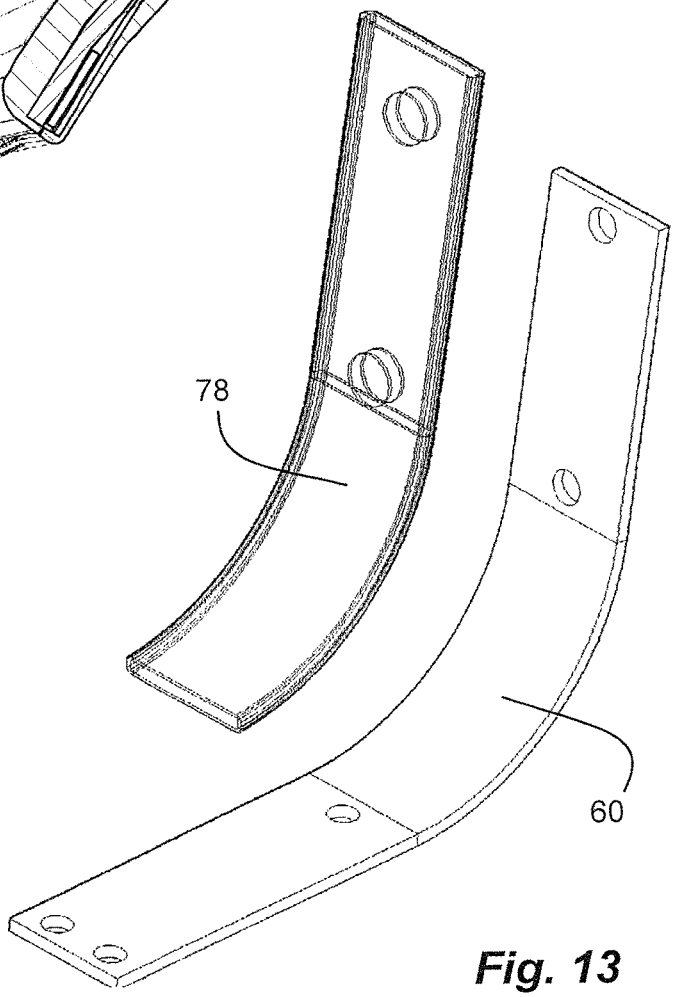
FIG. 13 is an exploded view of an arcuate leaf spring assembly of the chair of FIG. 1, showing an arcuate leaf spring and a sheath or a sleeve disposable over at least a portion of the arcuate leaf spring.
Figure 14:
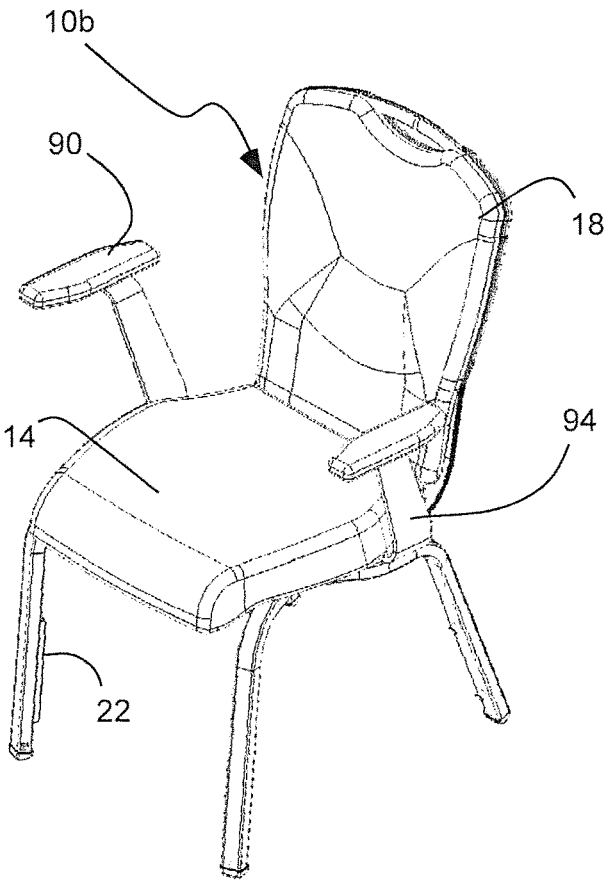
FIG. 14 is a front perspective view of another banquet chair in accordance with another embodiment of the present invention shown with arm rests.
Figure 15:
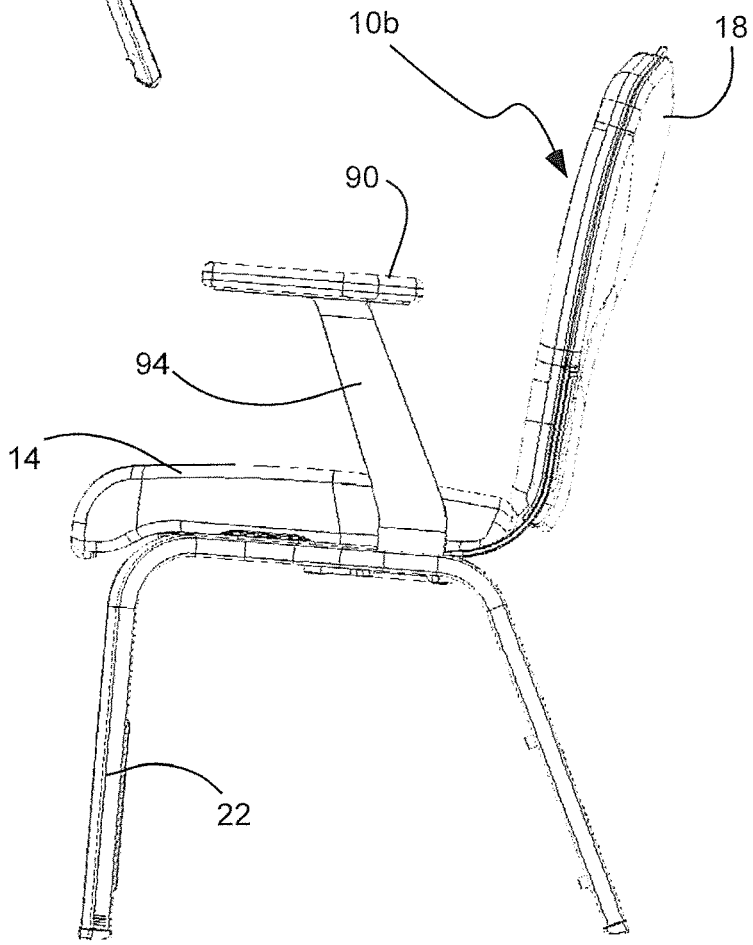
FIG. 15 is a side view of the chair of FIG. 14.
Figure 16:
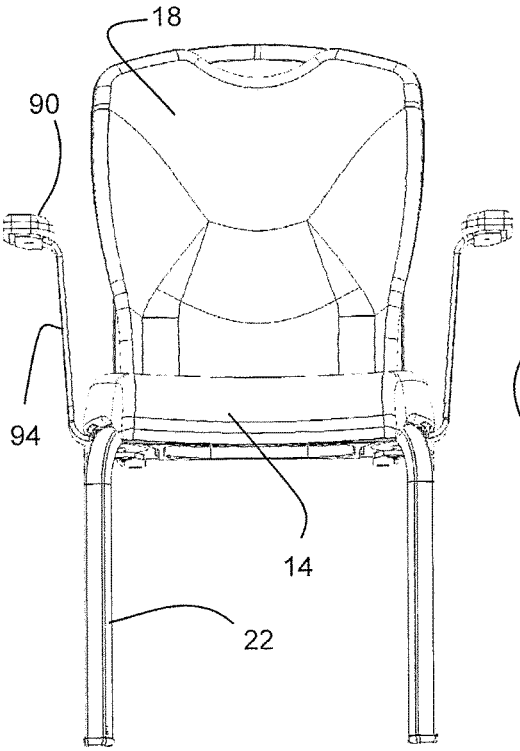
FIG. 16 is a front view of the chair of FIG. 14.
Figure 19:
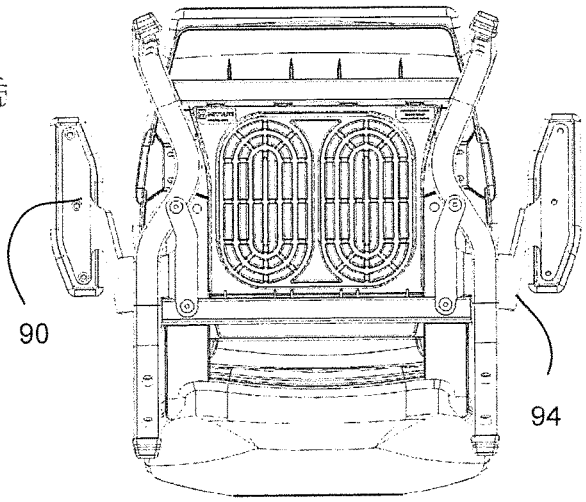
FIG. 19 is a bottom view of the chair of FIG. 14.
Figure 18:
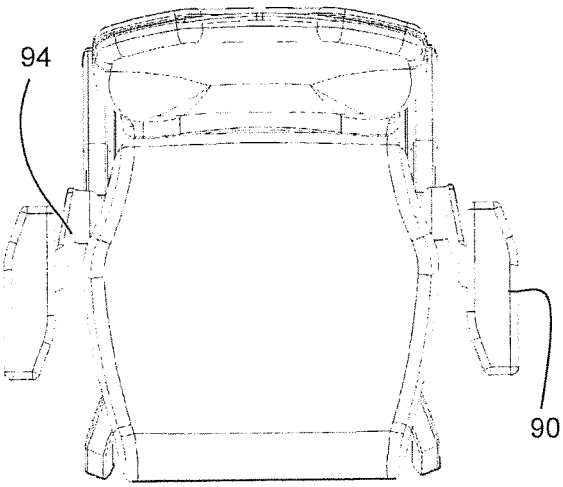
FIG. 18 is a top view of the chair of FIG. 14.
Figure 17:
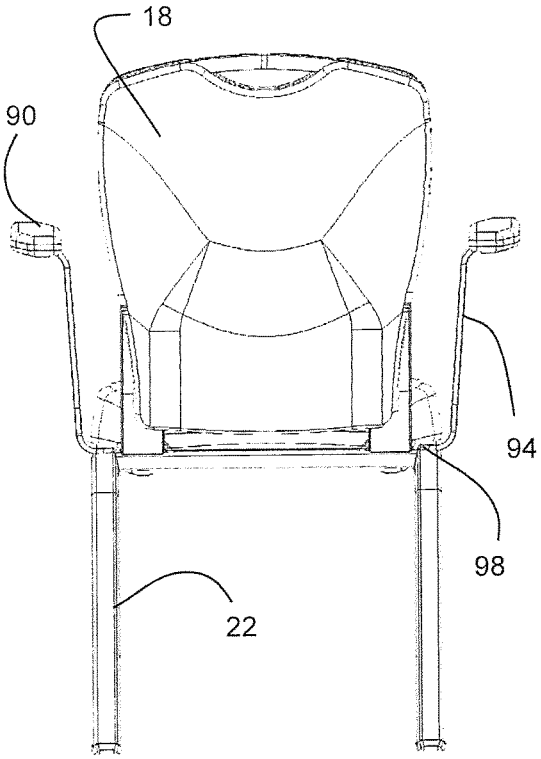
FIG. 17 is a rear view of the chair of FIG. 14.
Figure 20:
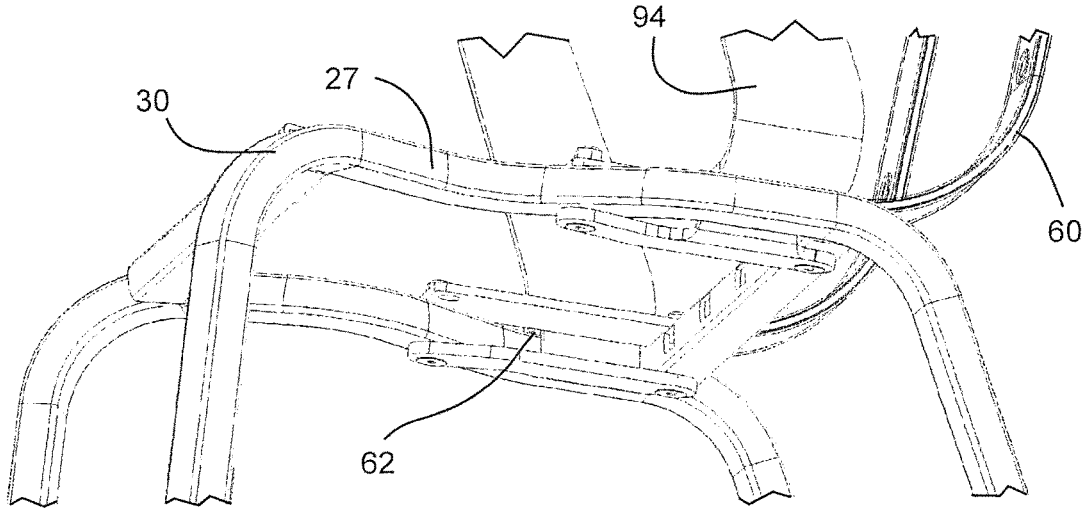
FIG. 20 is a partial bottom perspective view of the chair of FIG. 14.

As illustrated in FIGS. 1-13, a banquet chair, indicated generally at 10, in an example implementation in accordance with the invention is shown. The chair 10 has a seat 14 and a backrest 18 carried by a plurality of legs 22, or a frame 26 comprising the legs 22. The legs 22 and/or the frame 26 comprises a pair of front legs and a pair of rear legs (or a pair of left side legs and a pair or right side legs). The legs are spaced apart from one another, and inclined with respect to vertical so that spacing between the legs is wider at bottoms thereof and narrower at tops thereof to facilitate stacking. The tops of the legs can be connected together with lateral members 27 extending between the front and rear legs, and disposed generally at lateral sides of the chair or seat, and spars (front spar 28 and rear spar 29) extending between opposite lateral sides of the chair, and disposed general at the front and rear of the chair or seat. Thus, the framework can have the rear spar 28 extending between the lateral sides at a rear of the seat 14. The members interconnecting the tops of the legs, e.g. the lateral members and spars, can define a framework 30 disposed atop the legs to receive and carry the seat. Thus, the framework 30 can be oriented substantially horizontal (i.e. horizontal or with a slight incline with respect to horizontal for comfort and natural seating position). The legs 22, the frame 26 and/or the framework 30 can be formed of metal tubes bent to shape and welded together. For example, the legs can be formed of a pair of lateral leg assemblies joined together to form the frame. The lateral leg assembly can be formed by a single tube bent to form a front leg and a rear leg with an intermediate portion interconnecting the front and rear legs and forming the lateral member. Front and rear spars can interconnect the lateral leg assemblies. The lateral members can be shaped in a serpentine shape in the planer layer of the framework, comprising an indented portion 32, as discussed below. The rear legs can be spaced-apart from one another and have an inner leg width Wl defined between inner surfaces of rear legs (FIG. 6). The lateral members 27 of the framework 30 can form outermost lateral sides of the chair, the framework and/or the legs extending between front and rear legs.

The seat 14 can comprise a seat base 34 disposed over the framework. The seat base can be formed of plastic and can be formed by injection molding. The seat base can include integral compliant structure, such as bellows or concentric corrugation, to form flexible and resilient structure to deflect under weight for comfort. A perimeter flange can surround the compliant structure, and can be disposed on the framework with the compliant structure pendent or suspended therefrom and disposed in between the framework. The seat can also comprise a cushion 38 (FIG. 11), such as foam, carried by and disposed over the seat base 34, and a cover 42, such as fabric, surrounding the cushion and a perimeter of the seat base. The seat 14 can have a reverse hour-glass shape (i.e. a wider intermediate portion and narrower front and rear portions (FIG. 7) to accommodate legs of an adjacent stacked chair, and facilitate stacking. Thus, the corners of the seats are retracted with respect to front, back and lateral side perimeters of the seat to resist contact with legs of an adjacent stacked chair during stacking, to preserve the finish and appearance of the cover of the seat.

The backrest 18 can comprise a backing formed by a pair of panels, namely front and rear panels 46 and 48. The front and rear panels 46 and 48 can be formed of plastic, and can be formed by injection molding. The backrest 18 can also comprise a cushion 52 (FIG. 11), such as foam, carried by and disposed over the front panel 46, and a cover 56, such as fabric, surrounding the cushion and a perimeter of the front and rear panels. The backrest 18 can have a reverse hour-glass shape (i.e. a wider intermediate portion and narrower bottom and top portions (FIG. 5) to accommodate legs of an adjacent stacked chair, and facilitate stacking. The lateral perimeter of the backrest includes a slimmer portion 58 tapering inward from an intermediate portion to a bottom, such that a width Wb (FIG. 6) of the bottom of the backrest is less than a width of the intermediate portion of the backrest. Thus, at least the bottom corners of the backrest are retracted with respect to bottom and lateral side perimeters of the backrest to resist contact with legs of an adjacent stacked chair during stacking, to preserve the finish and appearance of the cover of the backrest.

The backrest 18 is coupled to the seat 14, the frame 26, the framework 30, and/or the legs 22 by a pair of arcuate leaf springs 60. The leaf springs 60 can flexibly couple the backrest 18 to the legs and with respect to the seat. The leaf springs can be formed of metal, such as steel. The leaf springs are flexible to flex or bend under an applied force and resilient to return to an unloaded position upon removal of the applied force. Thus, a the backrest can pivot or displace rearwardly with respect to the seat when a user lean rearwardly for added comfort. In one aspect, the leaf springs can be capable of unequal flexion with each of the leaf spring being capable of flexing a greater or a lesser amount than the other depending on how the user leans.

The leaf springs 60 can have a bottom (or bottom portion or bottom end), a top (or top portion or top end) and an intermediate portion. The top and bottom of the leaf spring can be linear or straight, while the intermediate portion can be arcuate, or can form an arc, between the top and the bottom. The arc of the leaf springs 60 orients the backrest 18 upright and transverse with respect to the seat 14. The leaf springs can have a length longer than a width, and the width wider than a thickness. The bottoms of the leaf springs 60 can be coupled to the framework 30, the legs 22, the frame 26 and/or the seat 14. The tops of the leaf springs can be coupled to the backrest 18 and/or panels 46 and 48 thereof. The tops and bottoms of the leaf springs can have bores to receive fasteners to couple the leaf spring to the framework and the backrest. The tops of leaf springs can be embedded within the backrest 18, or can be sandwiched between the front and rear panels 46 and 48. The bottoms of the leaf springs can be disposed under the seat 14 or seat base 34, and on top of the framework 30, and can be sandwiched between the seat or seat base and the framework. The intermediate portions of the leaf springs can be exposed between the seat 14 and the backrest 18. The seat and the backrest can be separated by a gap. As described above, the lateral members of the framework 30 can be serpentine with indented portions 32. The bottom ends of the leaf springs 60 can be coupled to the lateral sides 27 (at indentation 32) and the rear spar 29 of the framework 30. A gap 62 can be formed between the bottom of the leaf spring 60 and the framework 30, or the lateral member 27, because of the indentation 32, as discussed in greater detail below.

The leaf springs 60 are spaced-apart from one another, and have an outer spring width Ws (FIG. 6) defined between the outermost edges of the leaf springs. The outer spring width Ws can be at least 90 percent of the inner leg width Wl. A pair of gaps 64 (FIG. 6) can be formed respectively between the outermost edges of the leaf springs 60 and an inner surfaces of rear legs. The pair of gaps each having a width less than a width of a rear leg. In addition, each of leaf springs is located closer to a different outside edge of the seat and the backrest than to each other or a middle of the seat and the backrest. Thus, the leaf springs are closer to an outside of the chair (or seat or backrest) than to each other.

The leaf springs 60 have an outermost edge 70 exposed through a lateral perimeter of the backrest 18. The outermost edge 70 of the leaf springs is exposed by the slimmer portion 58 of the backrest 18, and the location of the leaf springs. The outermost edge 70 of the leaf springs has or defines an associated bearing surface against which an interior surface of a rear leg of another chair stacked thereon can bear against when stacked thereon. (The bearing surface can be formed directly by the leaf spring itself, or by a sheath as described below.) Thus, the exposed edge 70 of the leaf springs and the slimmer portion 58 of the backrest 18 resists contact between adjacent stacked legs and the cover 56 of the backrest to preserve the finish and appearance of the cover.

A pair of sheaths 78 (FIG. 13) can each be disposed on a different one of the pair of leaf springs 60. The sheath 78 covers an exposed portion of the leaf spring 60 exposed between the seat and the backrest, and the outermost edge of the leaf spring exposed through the lateral perimeter of the backrest. In one aspect, the sheath 78 can be a plastic sleeve slid over the leaf spring prior to coupling to the backrest. Thus, the sheath or sleeve can circumscribe the leaf spring and resist tampering or unauthorized removal. In another aspect, the sheath can be an envelope that can folded around a perimeter of the leaf spring. Thus, the envelope may be disposed around the leaf spring subsequent in the manufacturing process, and can facilitate replacement. In one aspect, the sheath or sleeve can be transparent or at least translucent so that the leaf spring is visible therethrough. The transparent or translucent sheath or sleeve may hide scuff marks. In another aspect, the sheath or sleeve can be opaque. The opaque sheath or sleeve may reduce costs of manufacturing the leaf spring. The sheath or sleeve can cover at least the exposed portion of the leaf spring. In one aspect, the sheath or sleeve can cover only the exposed portion of the leaf spring. Thus, the sheath or sleeve can be installed subsequently in the manufacture process, and can facilitate replacement. In another aspect, the sheath or sleeve can extend into the backrest, and can be secured to the backrest to resist undesired displacement of the sheath or sleeve along the leaf spring. The sheath or sleeve can have bores therein corresponding to bores in the leaf spring to receive fasteners. In another aspect, the sheath or sleeve can extend between the seat and the framework, and can be secured to the framework and/or the seat to avoid undesired displacement. The sheath or sleeve can provide the bearing surface of the leaf spring.

Referring to FIGS. 14-20, another banquet chair 10*b* is shown that is similar in most respects to that described above, and which description is hereby incorporated herein by reference. The banquet chair 10*b* can also have a pair of arm rests 90, each one disposed on an opposite side of the chair and/or the seat. The pair of armrests 90 has a pair of arm rest supports 94 which extend from the framework 30. The arm rest supports 94 can have bottom ends coupled the framework 30. In one aspect, the bottom ends of the arm rest supports 94 can be attached to a bottom of the framework 30, and can utilize the same fasteners and the same bore locations as the leaf springs 60. A portion of the framework 30 can be sandwiched between the bottoms of the arm rest supports 94 and the bottoms of the leaf springs 60. Bores in all of the arm rest supports 94, the framework 30 and the leaf springs 60 can be aligned and can receive fasteners therethrough. The bottoms of the arm rest supports 94 can be coupled to the lateral sides 27 (at indentation 32) and the rear spar 29 of the framework 30, similar to the bottoms of the leaf springs 60; and can also form the gap 62 along with the leaf springs, between the bottoms of the leaf spring 60 and the lateral member 27 of the framework, and the bottoms of the arm rest supports 94 and the lateral member 27 of the framework, because of the indentation 32. The gap 62 allows the arm rest support 94 to extend between the bottom of the leaf spring 60 and the lateral member 27 of the framework, and under the framework; and thus utilize the same mounting hardware as the leaf springs. The armrest supports extend from the bottom of the framework, and through a respective gap 62. In addition, the armrest supports 94 can have a step 98 formed therein, and the step can be disposed on the lateral member 27 of the framework 30 to provide support to the armrest.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A chair, comprising:

a) a seat and a backrest carried by a frame comprising a plurality of legs;

b) a pair of arcuate leaf springs flexibly coupling the backrest to the plurality of legs, and each having a bottom end coupled to the frame and a top end coupled to the backrest;

c) the pair of arcuate leaf springs being spaced-apart from one another; and d) the backrest having a lateral perimeter with a slimmer portion tapering inward from an intermediate portion to a bottom to expose lateral outermost edges of the pair of leaf springs beyond the lateral perimeter of the backrest at the bottom of the backrest.

2. The chair in accordance with claim 1, wherein the outermost edge of each of the pair of arcuate leaf springs has a bearing surface against which an interior surface of a rear leg of another chair stacked thereon bears against when stacked thereon.

3. The chair in accordance with claim 1, wherein each of the arcuate leaf springs has the bottom portion disposed under the seat, and an intermediate portion exposed in a gap between the seat and the backrest.

4. The chair in accordance with claim 1, further comprising:

an outer spring width defined between the outermost edges of the pair of arcuate leaf springs;

an inner leg width defined between inner surfaces of rear legs; and the outer spring width being at least 90 percent of the inner leg width.

5. The chair in accordance with claim 1, further comprising:

a pair of gaps, respectively, between the outermost edges of the pair of arcuate leaf springs and an inner surfaces of rear legs; and the pair of gaps each having a width less than a width of a rear leg.

6. The chair in accordance with claim 1, further comprising:

a pair of sheaths each disposed on a different one of the pair of arcuate leaf springs, and each covering an exposed portion of a respective arcuate leaf spring exposed between the seat and the backrest.

7. The chair in accordance with claim 1, wherein the backrest further comprises:

a) a pair of panels, including a front panel and a rear panel;

b) the top ends of the pair of arcuate leaf springs being sandwiched between the pair of panels;

c) a cushion carried by the front panel; and d) a covering disposed over the cushion.

8. The chair in accordance with claim 1, further comprising:

a) a substantially horizontal framework disposed atop the plurality of legs;

b) a seat base disposed over the framework;

c) the bottom ends of the pair of arcuate leaf springs being sandwiched between the seat base and the framework;

d) a cushion carried by the seat base; and e) a covering disposed over the cushion.

9. The chair in accordance with claim 1, further comprising:

a) a substantially horizontal framework disposed atop the plurality of legs;

b) the framework having outermost lateral sides extending between front and rear legs;

c) the framework having a rear spar extending between the lateral sides at a rear of the seat; and d) the bottom ends of the pair of arcuate leaf springs being coupled to the lateral sides and the rear spar of the framework.

10. The chair in accordance with claim 1, further comprising:

a) a substantially horizontal framework disposed atop the plurality of legs;

b) the bottom ends of the pair of arcuate leaf springs being coupled to a top of the framework;

c) a pair of arm rest supports with bottom ends coupled to a bottom of the framework; and d) a portion of the framework being sandwiched between the bottom ends of the pair of arcuate leaf springs and the bottom ends of the pair of arm rest supports.

11. The chair in accordance with claim 10, further comprising:

a gap formed between each bottom of each arcuate leaf spring and the framework; and each one of the pair of armrest supports extends from the bottom of the framework and through a respective gap.

12. The chair in accordance with claim 10, wherein each of the pair of armrest supports has a step formed therein and disposed on the framework.

13. The chair in accordance with claim 1, wherein each of the pair of arcuate leaf springs is flexible and resilient to flex or bend under an applied force and to return to an unloaded position upon removal of the applied force; and wherein the pair of leaf springs is capable of unequal flexion with each of the pair of leaf springs being capable of flexing a greater or a lesser amount than the other.

14. The chair in accordance with claim 1, wherein a width of the bottom of the backrest is less than a width between the outermost edges of the pair of arcuate leaf springs.

15. A chair, comprising:

a) a plurality of legs;

b) a framework disposed atop the plurality of legs and having outermost lateral side members;

c) a seat disposed over the framework;

d) a pair of leaf springs each having a bottom end coupled to a different one of the outermost lateral side members of the framework;

e) a backrest affixed to top ends of the pair of leaf springs;

f) the leaf springs being arcuate with the backrest oriented upright and transverse with respect to the seat;

g) the backrest being displaceable with respect to the seat by the pair of leaf springs;

h) the backrest having a lateral perimeter with a slimmer portion tapering inward from an intermediate portion to a bottom such that a width of the bottom of the backrest is less than a width of the intermediate portion of the backrest;

i) the pair of leaf springs being flexible and resilient to flex under an applied force applied to the backrest, and to return to an unloaded position upon removal of the applied force from the backrest;

j) the pair of leaf springs being spaced-apart from one another and located adjacent opposite lateral sides of the seat; and k) each of the pair of arcuate leaf springs having an outermost edge exposed beyond the lateral perimeter of the backrest by the slimmer portion of the backrest.

16. The chair in accordance with claim 15, wherein each of the arcuate leaf springs has a top portion embedded within the backrest, a bottom portion disposed under the seat, and an intermediate portion exposed between the seat and the backrest.

17. The chair in accordance with claim 15, further comprising:

a pair of sheaths each disposed on a different one of the pair of arcuate leaf springs, and each covering an exposed portion of a respective arcuate leaf spring exposed between the seat and the backrest.

18. The chair in accordance with claim 15, wherein the backrest further comprises:

a) a pair of panels, including a front panel and a rear panel;

b) the top ends of the pair of arcuate leaf springs being sandwiched between the pair of panel;

c) a cushion carried by the front panel; and d) a covering disposed over the cushion.

19. The chair in accordance with claim 15, wherein the width of the bottom of the backrest is less than a width between the outermost edges of the pair of arcuate leaf springs.

20. A chair, comprising:

a) a seat and a backrest carried by a frame with a plurality of legs;

b) a pair of arcuate leaf springs flexibly coupling the backrest to the plurality of legs, and each having a bottom end coupled to the frame and a top end embedded in the backrest;

c) the pair of arcuate leaf springs being spaced-apart from one another and located adjacent opposite lateral sides of the seat;

d) the backrest having a lateral perimeter with a slimmer portion tapering inward from an intermediate portion to a bottom such that a width of the bottom of the backrest is less than a width of the intermediate portion of the backrest;

e) the pair of arcuate leaf springs each having an outermost edge exposed beyond the lateral perimeter of the backrest by the slimmer portion of the backrest; and f) the outermost edge of each of the pair of arcuate leaf springs has a bearing surface against which an interior surface of a rear leg of another chair stacked thereon bears against when stacked thereon.

* * * * *